US010486922B2

(12) United States Patent
Horita et al.

(10) Patent No.: US 10,486,922 B2
(45) Date of Patent: Nov. 26, 2019

(54) SHEET FEEDING DEVICE AND IMAGE FORMING APPARATUS INCORPORATING THE SHEET FEEDING DEVICE

(71) Applicants: Hirofumi Horita, Kanagawa (JP); Jumpei Aoyama, Kanagawa (JP)

(72) Inventors: Hirofumi Horita, Kanagawa (JP); Jumpei Aoyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 5 days.

(21) Appl. No.: 15/783,205

(22) Filed: Oct. 13, 2017

(65) Prior Publication Data

US 2018/0127223 A1 May 10, 2018

(30) Foreign Application Priority Data

Nov. 9, 2016 (JP) ..... 2016-218555
Jul. 19, 2017 (JP) ..... 2017-139550

(51) Int. Cl.
*B65H 3/06* (2006.01)
*B65H 3/52* (2006.01)
(Continued)

(52) U.S. Cl.
CPC ..... *B65H 3/0638* (2013.01); *B65H 3/0684* (2013.01); *B65H 3/5215* (2013.01); *B65H 3/5261* (2013.01); *B65H 3/68* (2013.01); *B65H 1/04* (2013.01); *B65H 1/12* (2013.01); *B65H 3/0669* (2013.01); *B65H 9/166* (2013.01);
(Continued)

(58) Field of Classification Search
CPC .. B65H 3/0638; B65H 3/06; B65H 2601/324; B65H 2402/30; B65H 2402/32; B65H 2402/60; B65H 2402/515; B65H 2405/42; B65H 2405/43; B65H 3/0669;
(Continued)

(56) References Cited

U.S. PATENT DOCUMENTS 6,059,280 A * 5/2000 Yamauchi ..... B65H 3/5261 193/35 R
7,992,859 B2 * 8/2011 Shiina ..... G03G 15/6511 271/109
(Continued)

FOREIGN PATENT DOCUMENTS

JP 2006027746 A * 2/2006
JP 2006-315834 11/2006
(Continued)

*Primary Examiner* — Luis A Gonzalez
(74) *Attorney, Agent, or Firm* — Harness, Dickey & Pierce, P.L.C.

(57) ABSTRACT

A sheet feeding device, which is included in an image forming apparatus, includes a roller detachably attached to the image forming apparatus and configured to feed a sheet in a sheet conveying direction, a shaft configured to engage with the roller and transmit a driving force to the roller, a movable body configured to rotate in a direction of rotational axis and includes a holding portion configured to engage with the second engaging portion of the roller and rotatably hold the roller and a guide configured to guide attachment of the second engaging portion of the roller to the holding portion, and a biasing body configured to apply a biasing force and bias the movable body from a drive receiving side to a drive transmitting side.

17 Claims, 9 Drawing Sheets

(51) Int. Cl.

| | |
|---|---|
| ***B65H 3/68*** | (2006.01) |
| *B65H 1/12* | (2006.01) |
| *B65H 9/16* | (2006.01) |
| *B65H 1/04* | (2006.01) |

(52) U.S. Cl.
CPC .... *B65H 2402/31* (2013.01); *B65H 2402/515* (2013.01); *B65H 2402/521* (2013.01); *B65H 2402/52211* (2013.01); *B65H 2402/531* (2013.01); *B65H 2404/13171* (2013.01); *B65H 2404/13421* (2013.01); *B65H 2404/15212* (2013.01); *B65H 2405/325* (2013.01); *B65H 2601/324* (2013.01); *B65H 2801/09* (2013.01)

(58) Field of Classification Search
CPC ..... B65H 3/5261; B65H 2402/522; B65H 2402/52211; B65H 2402/531
See application file for complete search history.

(56) References Cited

U.S. PATENT DOCUMENTS

| | | | | |
|---|---|---|---|---|
| 8,079,586 | B2 * | 12/2011 | Watanabe | B65H 3/0638 271/145 |
| 9,272,858 | B2 * | 3/2016 | Hirose | B65H 3/0669 |
| 9,340,378 | B2 * | 5/2016 | Ueyama | B65H 5/06 |
| 2014/0077444 | A1 | 3/2014 | Fujii et al. | |
| 2014/0084534 | A1 * | 3/2014 | Ichikawa | B65H 3/0638 271/109 |
| 2015/0132039 | A1 * | 5/2015 | Tobinaga | G03G 15/6511 399/388 |
| 2015/0132040 | A1 | 5/2015 | Aoyama et al. | |
| 2015/0253715 | A1 | 9/2015 | Tobinaga et al. | |
| 2015/0274450 | A1 | 10/2015 | Fujii et al. | |
| 2015/0274452 | A1 | 10/2015 | Tanaka et al. | |
| 2017/0131674 | A1 * | 5/2017 | Tomoe | B65H 3/0684 |
| 2018/0120726 | A1 * | 5/2018 | Aono | B65H 27/00 |

FOREIGN PATENT DOCUMENTS

| | | |
|---|---|---|
| JP | 2007-126220 | 5/2007 |
| JP | 2008-162756 | 7/2008 |
| JP | 2008-169013 | 7/2008 |
| JP | 2009-280397 | 12/2009 |
| JP | 2010-208757 | 9/2010 |
| JP | 2011-046484 | 3/2011 |
| JP | 2011-051687 | 3/2011 |
| JP | 2012-062127 | 3/2012 |
| JP | 2012-193013 | 10/2012 |
| JP | 2014-019502 | 2/2014 |
| JP | 2014-169168 | 9/2014 |
| JP | 2015-003790 | 1/2015 |
| JP | 2015-016932 | 1/2015 |
| JP | 2015-020840 | 2/2015 |
| JP | 2015-089839 | 5/2015 |
| JP | 2015-093741 | 5/2015 |
| JP | 2016-147761 | 8/2016 |

* cited by examiner

SHEET FEEDING DEVICE AND IMAGE FORMING APPARATUS INCORPORATING THE SHEET FEEDING DEVICE

CROSS-REFERENCE TO RELATED APPLICATION

This patent application is based on and claims priority pursuant to 35 U.S.C. § 119(a) to Japanese Patent Application Nos. 2016-218555, filed on Nov. 9, 2016, and 2017-139550, filed on Jul. 19, 2017, in the Japan Patent Office, the entire disclosure of each of which is hereby incorporated by reference herein.

BACKGROUND

Technical Field

This disclosure relates to a sheet feeding device and an image forming apparatus, including the sheet feeding device, such as a copier, printer, facsimile machine, and a multifunction printer including at least two functions of the copier, printer, and facsimile machine, where the sheet feeding device is included therein.

Related Art

Image forming apparatuses such as copiers and printers include a sheet feeding device. Such a sheet feeding device includes a sheet feed roller and a sheet separation roller, which are worn relatively earlier than the other parts included in the sheet feeding device. In order to enhance the maintainability of the sheet feeding device, such sheet feed roller and sheet separation roller are provided as replaceable parts.

In a known sheet feeding device, a sheet feed roller and a drive shaft are detached or attached along with movement of opening and closing of a cover, so that the sheet feed roller is detached from or attached to the sheet feeding device.

In another known sheet feeding device, a user presses an operation part provided to a sheet feed roller, so as to cause the shaft of the sheet feed roller to detach from or attach to a bearing. With this action, the sheet feed roller is attached to or detached from the sheet feeding device.

Yet another known sheet feeding device includes a separation unit that includes a sheet separation roller and a conveyance guide cover. The separation unit is detachably attached to the sheet feeding device by screw. When a sheet separation roller is replaced, the whole separation unit is replaced by loosening or tightening the screws.

SUMMARY

At least one aspect of this disclosure provides a sheet feeding device including a sheet loader, a roller, a drive device, a shaft, a movable body, and a biasing body. The sheet loader is a loader on which a sheet is loaded. The roller is detachably attached to an apparatus body of an image forming apparatus and has a first engaging portion and a second engaging portion opposite to the first engaging portion. The roller is configured to feed the sheet loaded on the sheet loader in a sheet conveying direction. The drive device is configured to rotate the roller. The shaft is rotated by the drive device and is configured to engage with the first engaging portion of the roller and transmit a driving force to the roller. The movable body is configured to rotate in a direction of rotational axis. The movable body includes a holding portion and a guide. The holding portion is configured to engage with the second engaging portion of the roller and rotatably hold the roller. The guide is configured to guide attachment of the second engaging portion of the roller to the holding portion. The biasing body is configured to apply a biasing force and bias the movable body from a drive receiving side to a drive transmitting side.

Further, at least one aspect of this disclosure provides an image forming apparatus including the above-described sheet feeding device.

Further, at least one aspect of this disclosure provides sheet feeding device including a sheet loader, a first roller, a second roller, a holding body, a biasing body, and a cover. The sheet loader is a loader on which a sheet is loaded. The first roller is configured to feed the sheet loaded on the sheet loader in a sheet conveying direction. The second roller is configured to contact the first roller and form a nip region with the first roller. The holding body is rotatably supported thereto and is configured to rotatably support the second roller. The biasing body is configured to apply a biasing force and bias and rotate the holding body operable to cause the second roller to contact the first roller. The cover is detachably attached to the sheet feeding device and is configured to cover the second roller and the holding body operable to expose part of an outer circumferential surface of a roller body of the second roller. The cover is detached from the sheet feeding device due to deformation by application of manual pressure.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
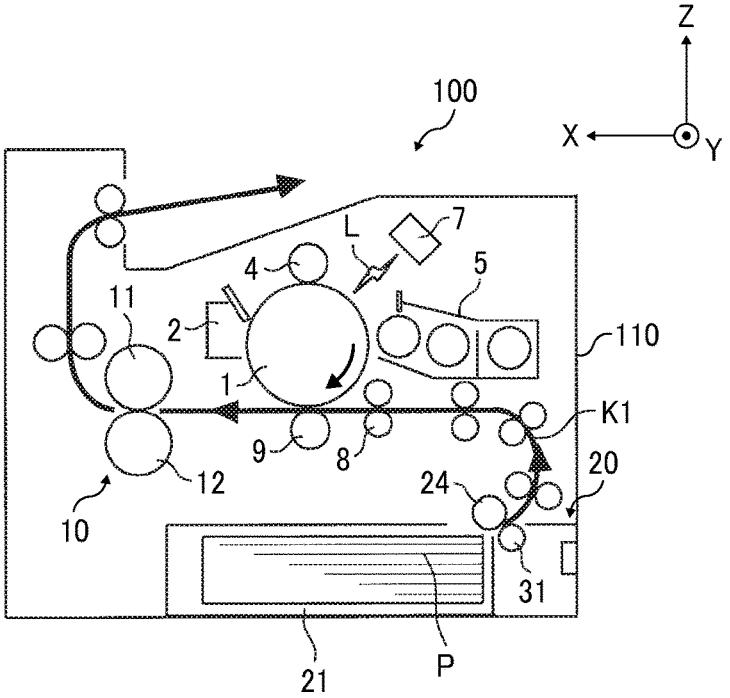
FIG. 1 is a diagram illustrating an overall configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Next, a description is given of a configuration and functions of an image forming apparatus 100 according to an embodiment of this disclosure, with reference to drawings. It is to be noted that identical parts are given identical reference numerals and redundant descriptions are summarized or omitted accordingly.

It is to be noted that identical parts are given identical reference numerals and redundant descriptions are summarized or omitted accordingly.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic printer that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

Now, a description is given of a basic configuration and functions of the image forming apparatus 100 with reference to FIG. 1.

In FIG. 1, the image forming apparatus 100 that is applied as a printer in this disclosure includes a photoconductor drum 1, a cleaning device 2, a charging roller 4, a developing device 5, an exposure device 7, a pair of registration rollers 8, a transfer roller 9, a fixing device 10, a fixing roller 11, a pressure roller 12, a sheet feeding device 20, and a sheet feed tray 21.

The photoconductor drum 1 forms a toner image on a surface thereof.

The exposure device 7 emits exposure light L that is generated based on image data inputted from an input device such as a personal computer, to the photoconductor drum 1.

The pair of registration rollers 8 is a pair of timing rollers to convey a sheet P toward a transfer nip region where the photoconductor drum 1 and the transfer roller 9 contact with each other.

The transfer roller 9 transfers the toner image borne on the photoconductor drum 1, onto the sheet P to be conveyed to the transfer nip region (a transfer position).

The fixing device 10 fixes and fuses the toner image that has not yet been fixed, to the sheet P. The fixing roller 11 and the pressure roller 12 are provided to the fixing device 10.

The sheet feeding device 20 feeds the sheet P contained in the sheet feed tray.

The charging roller 4, the developing device 5, and the cleaning device 2 are disposed around the photoconductor drum 1.

Now, a description is given of regular image forming operations performed by the image forming apparatus 100, with reference to FIG. 1.

First, image data is transmitted form the input device such as a personal computer to the exposure device 7 of the image forming apparatus 100. Then, the exposure light L (the laser light beam) based on the image data is emitted to the photoconductor drum 1 to irradiate the surface of the photoconductor drum 1.

Figure 2A:
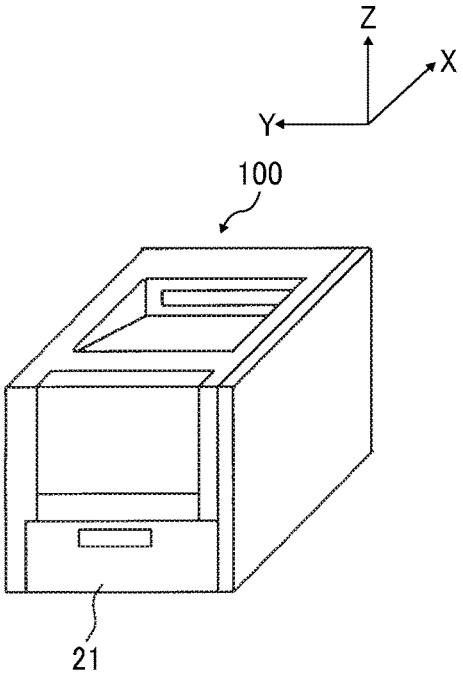
FIG. 2A is a perspective view illustrating the image forming apparatus.
Figure 2B:
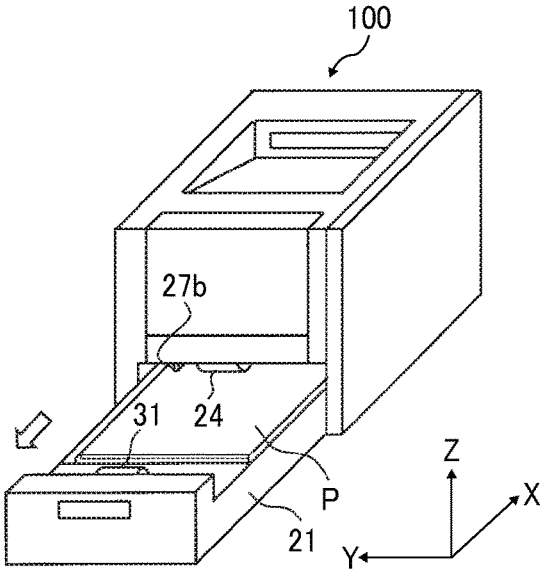
FIG. 2B is a perspective view illustrating the image forming apparatus with a sheet feed tray being pulled out.

The photoconductor drum 1 rotates in a direction indicated by arrow in FIG. 2B, that is, a clockwise direction. As the photoconductor drum 1 rotates, the charging roller 4 uniformly charges the surface of the photoconductor drum 1 at a position facing each other. (This is a charging process.)

As a result, a charging potential is formed on the surface of the photoconductor drum 1. In the present embodiment, the charging potential on the photoconductor drum 1 is around −900V (minus 900V). Then, as the photoconductor drum 1 further rotates, the charged surface of the photoconductor drum 1 is brought to a light emitting position of the exposure light L. The exposure light L emitted by the exposure device 7 irradiates an area of the surface of the photoconductor drum 1, so that the area has a latent image potential in a range of 0V to −100V (minus 100V). Accordingly, an electrostatic latent image is formed on the surface of the photoconductor drum 1. (This is an exposing process.)

Then, the surface of the photoconductor drum 1 having the electrostatic latent image comes to an opposing position to the developing device 5. The developing device 5 supplies toner onto the surface of the photoconductor drum 1, so that the electrostatic latent image formed on the surface of the photoconductor drum 1 is developed into a visible toner image. (This is a developing process.)

Then, the surface of the photoconductor drum 1 after the developing process reaches the transfer nip region where the photoconductor drum 1 and the transfer roller 9 contact with each other. A power source applies a transfer bias to the transfer roller 9 in the transfer nip region. This transfer bias has a polarity different from the polarity of toner. By application of the transfer bias to the transfer roller 9, the toner image formed on the surface of the photoconductor drum 1 is transferred onto the sheet P that is conveyed by the pair of registration rollers 8. (This is a transfer process.)

After completion of the transfer process, the surface of the photoconductor drum 1 then comes to an opposing position to the cleaning device 2. At this position, untransferred toner or residual toner remaining on the surface of the photoconductor drum 1 is mechanically removed by a cleaning blade. The residual toner removed from the photoconductor drum 1 by the cleaning blade is collected in the cleaning device 2. (This is a cleaning process.)

After these processes, a series of image forming processes of the photoconductor drum 1 is completed.

By contrast, the sheet P is conveyed to the transfer nip region (i.e., the transfer position) where the photoconductor drum 1 and the transfer roller 9 contact with each other as follows.

First, when an uppermost sheet P placed on top of a bundle of sheets P contained in the sheet feed tray 21 is fed by a sheet feed roller 24 toward a sheet conveying passage K1.

Thereafter, the sheet P reaches the pair of registration rollers 8. After reaching the pair of registration rollers 8, the sheet P (i.e., the uppermost sheet P) is conveyed toward the transfer nip region (i.e., a contact position where the transfer roller 9 and the photoconductor drum 1 contact with each other) in synchronization with movement of the toner image formed on the surface of the photoconductor drum 1 for positioning.

After completion of the transferring process, the sheet P passes the transfer nip region (the transfer roller 9), and then reaches the fixing device 10 via the sheet conveyance passage K1. In the fixing device 10, the sheet P is inserted into a fixing nip region between the fixing roller 11 and the pressure roller 12, so that the toner image is fixed to the sheet P by application of heat applied by the fixing roller 11 and pressure applied by the fixing roller 11 and the pressure roller 12. After having been discharged from the fixing nip region, the sheet P having the toner image fixed thereto is ejected from an apparatus body 110 of the image forming apparatus 100 onto a sheet ejection tray.

Accordingly, the series of image forming processes is completed.

It is to be noted that, as illustrated in FIGS. 2A and 2B, the sheet feed tray 21 in the present embodiment of this disclosure is detachably attached to the apparatus body 110 of the image forming apparatus 100. Consequently, when refilling or removing the sheet P, the sheet feed tray 21 is pulled out from the image forming apparatus 100 in a direction indicted by white arrow, which is a −X (minus X) direction, in FIG. 2B. That is, the sheet feed tray 21 is moved from a state illustrated in FIG. 2A to a state illustrated in FIG. 2B.

Now, a detailed description is given of a configuration and functions of the sheet feeding device 20 of the image forming apparatus 100 according to the present embodiment.

Figure 3:
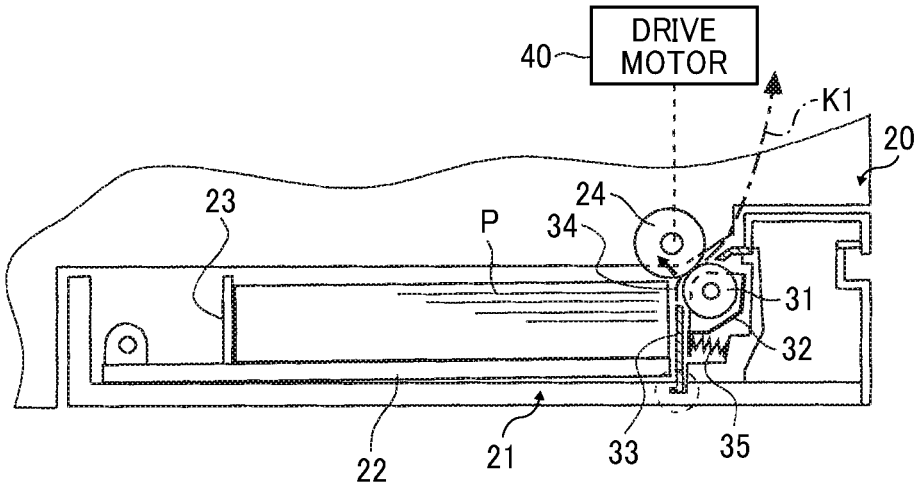
FIG. 3 is a diagram illustrating a sheet feeding device included in the image forming apparatus.

As illustrated in FIG. 3, the sheet feeding device 20 according to the present embodiment is a sheet feeding device having a sheet separation roller. The sheet feeding device 20 includes the sheet feed tray 21, the sheet feed roller 24, and a drive motor 40. The sheet feed tray 21 includes a base loading portion 22 (a bottom plate), a sheet separation roller 31, a pre-separation plate 34, an end fence 23, a cover 33, and a holding member 32. The sheet feed roller 24 feeds the sheet P contained in the sheet feed tray 21 toward the sheet conveying passage K1. The drive motor 40 functions as a drive device to drive and rotate the sheet feed roller 24 in the counterclockwise direction in FIG. 3.

The sheet feed roller 24 and the drive motor 40 that functions as a drive device are disposed not on a side of the sheet feed tray 21 but are disposed on a side of apparatus body 110 of the image forming apparatus 100. Therefore, as illustrated in FIG. 2B, when the sheet feed tray 21 is pulled out from apparatus body 110 of the image forming apparatus 100, the sheet feed roller 24 and the drive motor 40 do not move together with the sheet feed tray 21 but remain in the apparatus body 110 of the image forming apparatus 100.

Multiple sheets P are loaded on top of each other, on the base loading portion 22 (the base plate). The base loading portion 22 that functions as a sheet loader ascends and descends to move the sheet P loaded on the base loading portion 22 in a vertical direction, so that the sheet P is elevated to a position where the sheet P contacts the sheet feed roller 24. An elevation mechanism that causes the base loading portion 22 (the base plate) to elevate or vertically move can employ a known technique.

The sheet feed roller 24 is rotated in the counterclockwise direction in FIG. 3, by the drive motor 40 (the drive device) in a state in which the sheet feed roller 24 contacts the upper face of the sheet P loaded on the base loading portion 22, so that the sheet P is fed to a predetermined sheet conveying direction, which is indicated by a broken line arrow of FIG. 3.

Figure 4:
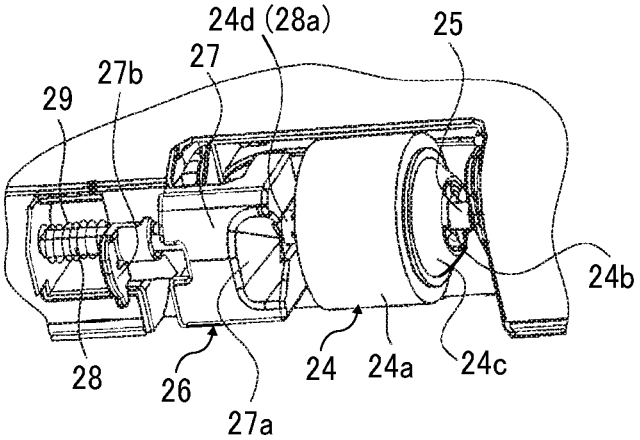
FIG. 4 is an enlarged perspective view illustrating a state in which a sheet feed roller is provided to the sheet feeding device, viewed from below.
Figure 5:
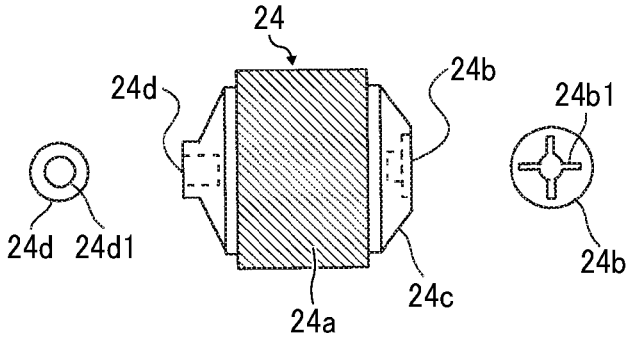
FIG. 5 is a diagram illustrating the sheet feed roller.

As illustrated in FIGS. 3, 4 and 5, the sheet feed roller 24 includes a roller body 24*a* having a surface layer made of rubber material. Therefore, the sheet feed roller 24 has a relatively fast rate of deterioration with age. Accordingly, in order to maintain a good sheet feeding performance with age, the sheet feed roller 24 of the sheet feeding device 20 is replaced in a relatively short cycle time.

It is to be noted that, as illustrated in FIG. 2B, replacement of the sheet feed roller 24 is performed in a state in which the sheet feed tray 21 is pulled out (or completely removed) from the apparatus body 110 of the image forming apparatus 100 and in a in a state in which the sheet feed roller 24 is exposed to a space below.

The sheet separation roller 31 is biased by a biasing force applied by a compression spring 35 that functions as a biasing body, toward the sheet feed roller 24. The sheet separation roller 31 contacts the sheet feed roller 24 to form a sheet feeding nip region therebetween. The sheet separation roller 31 functions as a sheet separation body to separate the uppermost sheet P from the other subsequent sheets of the bundle of sheet P on the base loading portion 22 when multiple sheets P are held between the sheet separation roller 31 and the sheet feed roller 24, and causes the uppermost sheet P alone to be fed toward the sheet conveyance passage K1 in the image forming apparatus 100. A roller body 31*a* of the sheet separation roller 31 (see FIGS. 9A and 9B) and the roller body 24*a* of the sheet feed roller 24 have respective surface friction coefficients. The magnitude relation of the surface friction coefficient of the roller body 24*a* and the surface friction coefficient of the roller body 31*a* are set to the same as known values.

A roller body 31*a* of the sheet separation roller 31 (see FIGS. 9A and 9B) and the roller body 24*a* of the sheet feed roller 24 have respective surface friction coefficients. The magnitude relation of the surface friction coefficient of the roller body 24*a* and the surface friction coefficient of the roller body 31*a* are set to the same as known values. The roller body 31*a* of the sheet separation roller 31 illustrated in FIGS. 9A and 9B has a surface layer made of rubber material. Therefore, the sheet separation roller 31 has a relatively fast rate of deterioration with age. Accordingly, in order to maintain a good sheet feeding performance with age, the sheet separation roller 31 of the sheet feeding device 20 is replaced in a relatively short cycle time, which is the same as the sheet feed roller 24.

It is to be noted that, as illustrated in FIG. 2B, replacement of the sheet separation roller 31 is performed in the state in which the sheet feed tray 21 is pulled out (or completely removed) from the apparatus body 110 of the image forming apparatus 100. This action is described in detail later, with reference to FIGS. 7 and 8.

Figure 7:
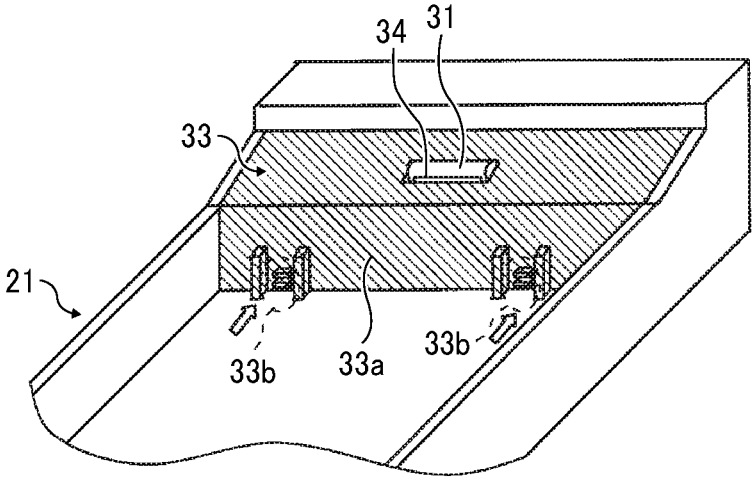
FIG. 7 is a perspective view illustrating the sheet feed tray.

The pre-separation plate 34 is a planar member made of metal bent in a substantially boomerang shape (a substantially L-shape) and is rotatably supported by the cover 33 (see FIG. 7). The pre-separation plate 34 is biased by a second biasing member 36 (see FIG. 8B) such as a spring, in a direction indicted by white arrow of FIG. 3, so that the pre-separation plate 34 contacts the sheet feed roller 24 upstream, in the sheet conveying direction, from a position at which the sheet separation roller 31 contacts the sheet feed roller 24.

By providing the pre-separation plate 34, the possibility of multifeed errors in which multiple sheets P are fed by the sheet feed roller 24 is further reduced reliably.

The end fence 23 regulates a trailing end position of the sheet P, that is, an extreme upstream side of the sheet P loaded on the base loading portion 22 in the sheet conveying direction (that is, on the left side of FIGS. 2 and 3). The end fence 23 is movably disposed to perform manual adjustment of the position of the sheet P in the sheet conveying direction, according to the size of the sheet P in the sheet conveying direction.

The sheet feeding device 20 further includes a side fence to regulate a position of the sheet P loaded on the base loading portion 22, in a width direction, which is perpendicular to the sheet conveying direction and orthogonal to the drawing sheet of FIG. 3. The side fence is movably disposed to perform manual adjustment of the position of the sheet P in the width direction, according to the size of the sheet P in the width direction.

As illustrated in FIG. 4, the sheet feeding device 20 according to the present embodiment of this disclosure includes the sheet feed roller 24, a drive shaft 25, a movable member 26, and a compression spring 29 that functions as a biasing member, on the side of apparatus body 110 of the image forming apparatus 100.

As illustrated in FIG. 5, the roller body 24*a* is disposed at the center of the sheet feed roller 24. The sheet feed roller 24 further includes a drive side engaging portion 24*b* on a drive side end face and a driven side engaging portion 24*d* on a driven side end face.

Figure 6A:
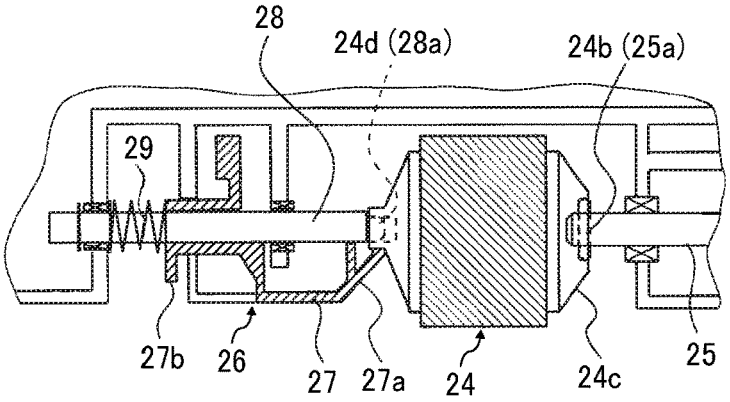
FIG. 6A is a diagram illustrating a process of removal of the sheet feed roller from the sheet feeding device.
Figure 6B:
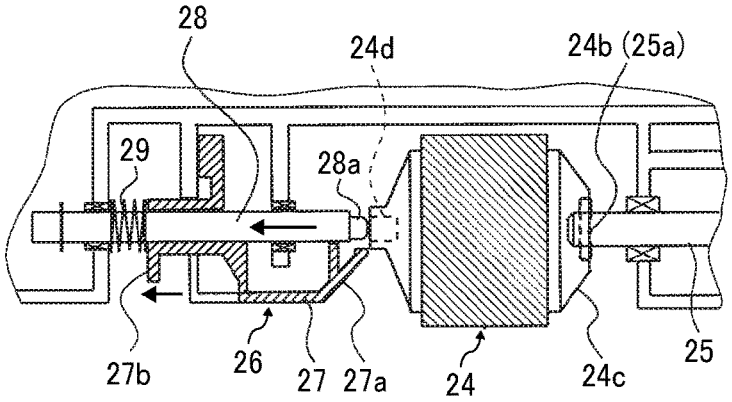
FIG. 6B is a diagram illustrating another process of removal of the sheet feed roller from the sheet feeding device.
Figure 6C:
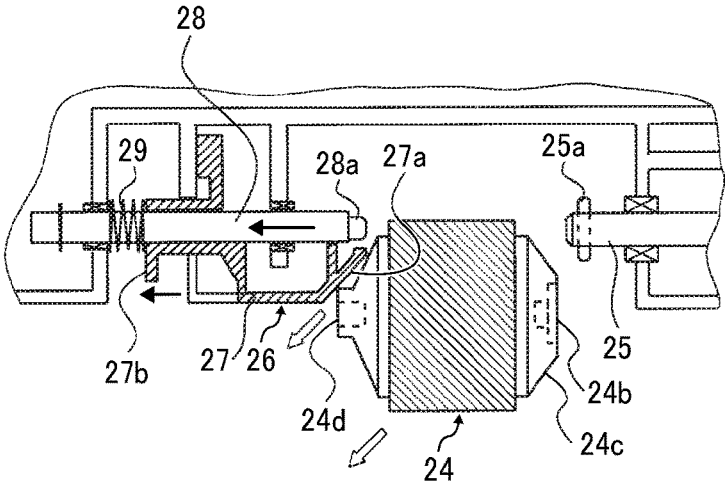
FIG. 6C is a diagram illustrating yet another process of removal of the sheet feed roller from the sheet feeding device.

The drive side engaging portion 24*b* includes a groove 24*b*1 having a substantially plus shape (a substantially cross shape). A pin 25*a* mounted on the drive shaft 25 is inserted into the groove 24*b*1 of the drive side engaging portion 24*b*, as illustrated in FIGS. 6A, 6B and 6C.

The driven side engaging portion 24*d* includes a groove 24*d*1 having a round shape. A holding portion 28*a* at the leading end of a shaft 28 provided to the movable member 26 is inserted into the groove 24*d*1 of the driven side engaging portion 24*d*, as illustrated in FIGS. 6A, 6B and 6C.

The sheet feed roller 24 has a substantially conical frustum shape. That is, the distance between the roller body 24*a* and the drive side engaging portion 24*b* becomes narrower toward the drive side. Specifically, the outer diameter of the drive side end face is smaller than the outer diameter of the roller body 24*a*, so as to form a tapered portion 24*c* between the roller body 24*a* and the drive side engaging portion 24*b*.

Another tapered portion is provided between the roller body 24*a* and the driven side engaging portion 24*d*.

The drive shaft 25 is coupled to the drive motor 40 directly (or indirectly via a gear train) to be driven and rotated by the drive motor 40. Then, the drive shaft 25 is inserted into the drive side engaging portion 24*b* of the sheet feed roller 24 to transmit the driving force to the sheet feed roller 24. Specifically, as illustrated in FIGS. 6A, 6B and 6C, the pin 25*a* is pressed to the leading end of the drive shaft 25 so that the pin 25*a* goes through a direction perpendicular to a direction of a rotational axis of the drive shaft 25. Then, the pin 25*a* is engaged with the substantially plus shaped groove at a portion in any direction of the plus shape thereof. By so doing, the sheet feed roller 24 is coupled to the drive shaft 25, and therefore the sheet feed roller 24 is rotated by the drive motor 40 in a predetermined direction.

As illustrated in FIGS. 4, 6A, 6B and 6C, the movable member 26 includes a movable main portion 27 made of resin and the shaft 28 made of metal. The shaft 28 is inserted into the movable main portion 27 by press fitting (or insert molding) to a single unit. The movable member 26 has the holding portion 28*a*, a guide 27*a*, and a handle 27*b*.

Further, the movable member 26 (including the movable main portion 27 and the shaft 28) is movable in the direction of the rotational axis (i.e., the left and right directions in FIGS. 6A, 6B and 6C). Specifically, the shaft 28 of the movable member 26 is supported by a housing of the sheet feeding device 20 included in the apparatus body 110 of the image forming apparatus 100, via a bearing. Further, the movable main portion 27 of the movable member 26 is disposed such that the movable main portion 27 slides in the direction of the rotational axis on a sliding face of the housing of the sheet feeding device 20 included in the apparatus body 110 of the image forming apparatus 100. According to this configuration, when the sheet feed roller 24 is replaced, the movable member 26 (the movable main portion 27 and the shaft 28) is moved in both directions along the rotational axis while maintaining the position in the direction of rotation thereof.

The holding portion 28*a* is inserted into the driven side engaging portion 24*d* of the sheet feed roller 24 and rotatably holds the sheet feed roller 24. The holding portion 28*a* is mounted at the leading end (on the drive side) of the shaft 28 of the movable member 26. The holding portion 28*a* of the shaft 28 has the outer diameter smaller than the other part of the shaft 28 and has a hemispherical leading end.

The guide 27*a* guides the driven side engaging portion 24*d* of the sheet feed roller 24 to be attached to the holding portion 28*a*.

To be more specific, when the sheet feed roller 24 is attached to or detached from (that is, replaced to) the sheet feeding device 20 included in the apparatus body 110 of the image forming apparatus 100, the guide 27*a* guides movement in which the driven side engaging portion 24*d* of the sheet feed roller 24 is inserted and attached to the holding portion 28*a* of the movable member 26 (or movement in which the driven side engaging portion 24*d* of the sheet feed roller 24 is detached from the holding portion 28*a* of the movable member 26). The guide 27*a* has a sloped face that tilts toward the holding portion 28*a* from the driven side to the drive side, viewed from a proximal side of a direction of insertion (attachment) of the sheet feed roller 24 (that is, a direction perpendicular to the drawing sheet of FIG. 4). The sheet feed roller 24 is attached to or detached from the sheet feeding device 20 while the driven side engaging portion 24*d* is being slid along the guide 27*a* (the sloped face).

The compression spring 29 that functions as a biasing member biases the movable member 26 from the driven side to the drive side.

To be more specific, the compression spring 29 is wound around the shaft 28 at a position closer to the driven side from the movable member 26, between the housing of the sheet feeding device 20 of apparatus body 110 of the image forming apparatus 100 and the movable main portion 27 of the movable member 26. The movable member 26 includes a stopper to prevent limitless movement of the movable member 26 to the drive side by the biasing force of the compression spring 29. The stopper of the movable member 26 is formed at a position at which the stopper can contact the housing of the sheet feeding device 20.

It is to be noted that, in the present embodiment of this disclosure, the compression spring 29 is employed as a biasing member to bias the movable member 26 from the driven side toward the drive side. However, the biasing member is not limited thereto. For example, a leaf spring can employed as a biasing member to be applied to this disclosure.

As illustrated in FIG. 2B, the handle 27*b* is formed on the movable main portion 27 of the movable member 26, to be projected at a position where the handle 27*b* is exposed outside from the sheet feeding device 20 (the apparatus body 110 of the image forming apparatus 100) in a state in which the sheet feed tray 21 is removed from the apparatus body 110 of the image forming apparatus 100. The handle 27*b* is located so that the movable member 26 is rotated in the direction of the rotational axis against the biasing force of the compression spring 29 (the biasing member) in a state in which the handle 27*b* is held. That is, a user holds the handle 27*b* that is exposed below the sheet feeding device 20 of the apparatus body 110 of the image forming apparatus 100 in the state in which the sheet feed tray 21 is removed, as illustrated in FIG. 2B, and moves the handle 27*b* toward the driven side of the rotational axis (i.e., the left side in FIGS. 6A, 6B and 6C). By so doing, the movable member 26 (the movable main portion 27 and the shaft 28) is moved to the same direction as the handle 27*b*. Accordingly, the driven side engaging portion 24*d* of the sheet feed roller 24 is detached from the holding portion 28*a*.

Comparative sheet feeding devices do not have sufficient operability for replacing a sheet feed roller and a sheet separation roller. That is, the operability in maintenance of the comparative sheet feeding devices is not sufficient.

Specifically, even though the comparative sheet feeding devices release engagement of the sheet feed roller and a drive shaft or the bearing by moving a cover and an operation part, removal of the sheet feed roller after disengaged from the drive shaft or a bearing is difficult. In addition, when attaching the sheet feed roller, the sheet feed roller and the drive shaft are positioned. Therefore, the operability of attachment of the sheet feed roller is relatively low.

Further, the sheet separation roller is attached to or detached from the comparative sheet feeding device with screws and tools for tightening or loosening the screws. Therefore, the operability of replacement of the sheet separation roller is relatively low.

Next, a description is given of a series of processes for replacement of the sheet feed roller 24, with reference to FIGS. 6A, 6B and 6C.

First, as illustrated in FIG. 6A, the sheet feed roller 24 that has already been provided to the sheet feeding device 20 of the apparatus body 110 of the image forming apparatus 100 is detached from the sheet feeding device 20. As illustrated in FIG. 2B, the handle 27*b* that is exposed below the sheet feeding device 20 of the apparatus body 110 of the image forming apparatus 100 is held in the state in which the sheet feed tray 21 is removed from the apparatus body 110 of the image forming apparatus 100.

Further, as illustrated in FIG. 6B, the handle 27*b* is moved to the driven side of the direction of the rotational axis (i.e., the left side in FIGS. 6A, 6B and 6C), so that the movable member 26 (the movable main portion 27 and the shaft 28) is moved in the same direction as the handle 27*b*. By so doing, attachment of the holding portion 28*a* and the sheet feed roller 24 (the driven side engaging portion 24*d*) are detached from each other. Consequently, while holding the handle 27*b* in one hand to maintain the above-described position of the movable member 26, the user holds the sheet feed roller 24 in the other hand and moves the sheet feed roller 24 to slide along the guide 27*a* (the sloped face) in a direction indicted by white arrow in FIG. 6C. By so doing, the sheet feed roller 24 is removed as illustrated in FIG. 6C. Accordingly, while the sheet feed roller 24 (the drive side engaging portion 24*b*) and the drive shaft 25 are being detached from each other, the sheet feed roller 24 is pulled out and removed easily. That is, the operability is enhanced in detachment of the sheet feed roller 24 after attachment of the sheet feed roller 24 and the drive shaft 25 and the holding portion 28*a* has been released.

Then, after the old sheet feed roller 24 has been removed, a sheet feed roller 24 (i.e., a new sheet feed roller 24 or a post-maintenance sheet feed roller 24) is attached to the sheet feeding device 20 (of the apparatus body 110 of the image forming apparatus 100). This attaching process of the sheet feed roller 24 is performed in the reverse order of the above-described detaching process of the sheet feed roller 24. At this time, as illustrated in FIG. 6C, the sheet feed roller 24 is moved in a reverse direction as indicted by white arrow in FIG. 6C by causing the driven side engaging portion 24*d* on the guide 27*a* (the sloped face). Then, the sheet feed roller 24 smoothly reaches a position where the sheet feed roller 24 and the drive shaft 25 and the holding portion 28*a* are attached. That is, the operability is enhanced in positioning of the sheet feed roller 24 relative to the drive shaft 25 and the holding portion 28*a* when the sheet feed roller 24 is attached.

It is to be noted that the biasing force applied by the compression spring 29 (the biasing member) is provided by a sufficient amount to maintain the attachment of the sheet feed roller 24 and the drive shaft 25 and the attachment of the sheet feed roller 24 and the holding portion 28*a*. That is, the amount to maintain these attachments are not large. Therefore, different from the above-described operation in which the movable member 26 is moved in the direction of the rotational axis by a user holding and moving the handle 27*b* in the direction of the rotational axis, the movable member 26 can be moved in the direction of the rotational axis by the user contacting the driven side engaging portion 24*d* of the sheet feed roller 24 with the guide 27*a* (the sloped face) and pressing the driven side engaging portion 24*d* of the sheet feed roller 24 to the left side of FIGS. 6A, 6B and 6C while holding both ends of the roller body 24*a* of the sheet feed roller 24. Consequently, while the movable member 26 is being moved in the direction of the rotational axis, the sheet feed roller 24 is attached to or detached from the sheet feeding device 20. In this case, the setting of the handle 27*b* to the movable member 26 can be omitted.

Next, a description is given of the configuration of the sheet feed tray 21 and a series of processes of replacement of the sheet separation roller 31, with reference to FIGS. 7 through 9.

As described above, with reference to FIGS. 2 and 3, the sheet feed tray 21 is detachably attached to the apparatus body 110 of the image forming apparatus 100. As previously described, the sheet feed tray 21 includes the base loading portion 22 (the bottom plate), the sheet separation roller 31, the pre-separation plate 34, the second biasing member 36, the end fence 23, the cover 33 and the holding member 32.

As illustrated in FIG. 7, the cover 33 covers the sheet separation roller 31 and the holding member 32 such that part of an outer circumferential surface of the roller body 31*a* of the sheet separation roller 31 is exposed. According to this configuration, even if a part such as the sheet separation roller 31 is damaged or broken when a user touches the part in setting of a sheet P or a bundle of sheets Pin the sheet feed tray 21, such inconvenience can be prevented.

Further, the cover 33 functions as a part or the entire of an inner wall face 33*a* disposed at the downstream side of the sheet conveying direction, in a space where the sheet P is loaded and contained. To be more specific, the cover 33 is provided such that the leading end of the sheet P contacts the inner wall face 33*a* according to the sheet P of the maximum size settable in the sheet feed tray 21. According to this configuration, the operability is enhanced in setting of the sheet P or the bundle of sheets P in the sheet feed tray 21.

Figure 8A:
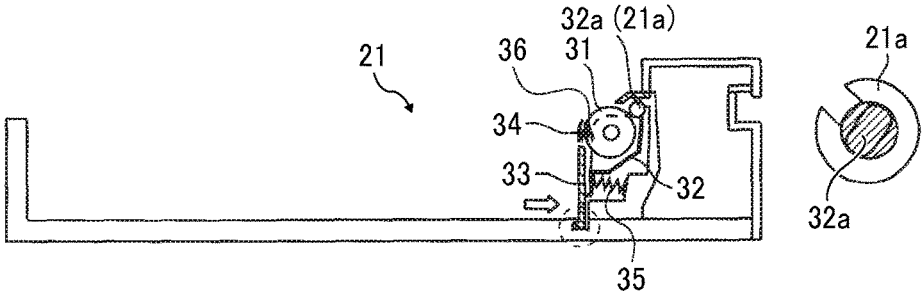
FIG. 8A is a diagram illustrating a process of removal of a sheet separation roller from the sheet feed tray.

Further, the cover 33 is made of resin and is detachably attached to the sheet feed tray 21 of the sheet feeding device 20. Further, when pressed manually, the cover 33 is deformed or bent to detach from the sheet feed tray 21 of the sheet feeding device 20. In other words, the cover 33 is detached from the sheet feed tray 21 of the sheet feeding device 20 due to deformation by application of manual pressure. Specifically, the cover 33 has an engaging portion to be engaged with the sheet feed tray 21, and the engaging portion of the cover 33 includes a snap-fit structure, as indicate by surrounding with a broken line as illustrated in FIG. 8A.

Further, as illustrated in FIG. 7, portions of the cover 33 to be pressed manually (i.e., pressure portions 33*b*) include rib-like projections. The pressure portions 33*b* are provided respectively at both ends in the width direction of the cover 33, in the vicinity of the parts having the snap-fit structure. When the pressure portions 33*b* are pressed, the cover 33 is elastically bent to release or disconnect the joint of the snap-fit structure. The pressure portions 33*b* have the rib-like projections, and therefore are easily visible, different from the other part of the inner wall face 33*a*. Therefore, the cover 33 can be removed easily.

It is to be noted that, as previously described with reference to FIG. 3, the cover 33 includes the pre-separation plate 34 and the second biasing member 36. Therefore, when the cover 33 is detached from the sheet feed tray 21, the pre-separation plate 34 and the second biasing member 36 are also detached from the sheet feed tray 21, together with the cover 33.

Figure 9A:
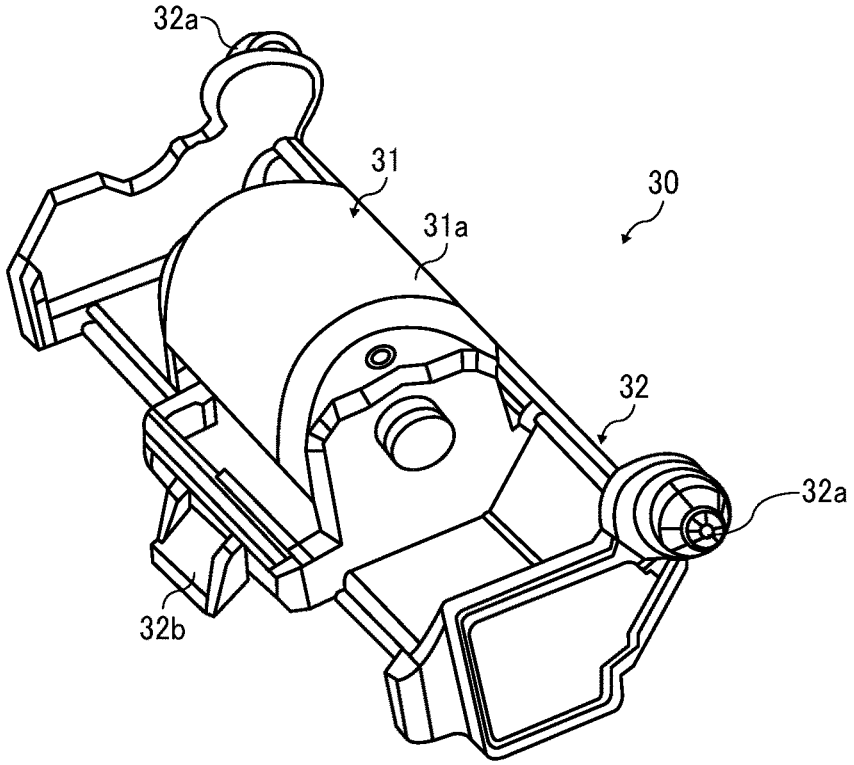
FIG. 9A is a perspective view illustrating a sheet separation roller unit.

Further, additionally referring to FIG. 9A, the holding member 32 is a bracket to which the sheet separation roller 31 is rotatably supported via a bearing. In the present embodiment of this disclosure, the sheet feeding device 20 includes a sheet separation roller unit 30 with the sheet separation roller 31 in a state in which the sheet separation roller 31 is rotatably supported by the holding member 32. When performing replacement or maintenance of the sheet separation roller 31, the whole sheet separation roller unit 30 is removed from the sheet feed tray 21.

With reference to FIGS. 8A, 8B, 8C and 8D, the holding member 32 is rotatably supported by the sheet feed tray 21 of the sheet feeding device 20. Specifically, a rotary shaft 32*a* provided to the holding member 32 is attached to a support shaft 21*a* that is fixed to a housing of the sheet feed tray 21. By so doing, the holding member 32 of the sheet separation roller unit 30 is supported to be rotatable about the support shaft 21*a*.

The compression spring 35 that functions as a biasing member rotates while biasing the holding member 32 of the sheet separation roller unit 30 so that the sheet separation roller 31 contacts the sheet feed roller 24. One end of the compression spring 35 (the biasing member) is fixedly supported to the housing of the sheet feed tray 21. The other end of the compression spring 35 contacts the holding member 32 of the sheet separation roller unit 30 to bias the holding member 32, so as to cause the holding member 32 of the sheet separation roller unit 30 to rotate about the support shaft 21*a* in the clockwise direction in FIGS. 8A, 8B, 8C and 8D. Accordingly, while the sheet feed tray 21 is attached to the apparatus body 110 of the image forming apparatus 100, the sheet separation roller 31 contacts the sheet feed roller 24 with a desired contact pressure to cause the sheet separation roller 31 to perform separation of the sheet P.

Figure 8B:
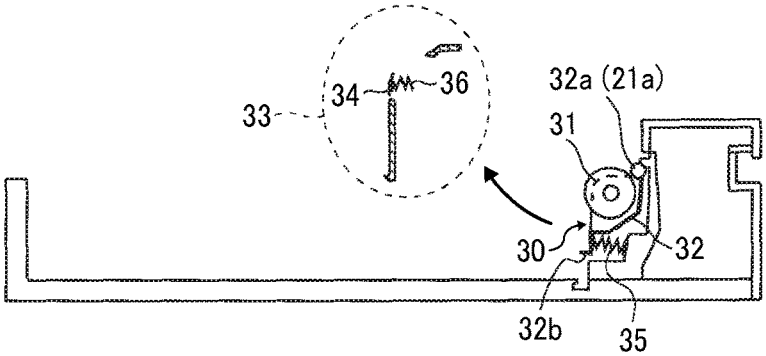
FIG. 8B is a diagram illustrating another process of removal of a sheet separation roller from the sheet feed tray.
Figure 8C:
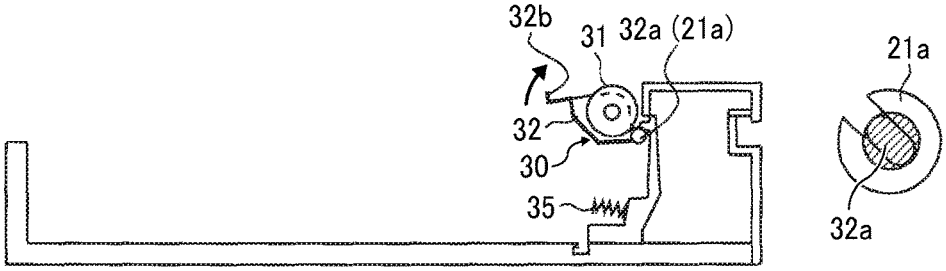
FIG. 8C is a diagram illustrating yet another process of removal of a sheet separation roller from the sheet feed tray.

In the present embodiment of this disclosure, while the cover 33 is removed from the sheet feed tray 21 of the sheet feeding device 20 and the sheet separation roller 31 is not in contact with the sheet feed roller 24, the holding member 32 can be removed as the sheet separation roller unit 30, from the sheet feed tray 21, while supporting the sheet separation roller 31 after the holding member 32 has been rotated to a predetermined position indicated in FIG. 8C, beyond the contact position at which the sheet separation roller 31 and the sheet feed roller 24 contact with each other.

Figure 8D:
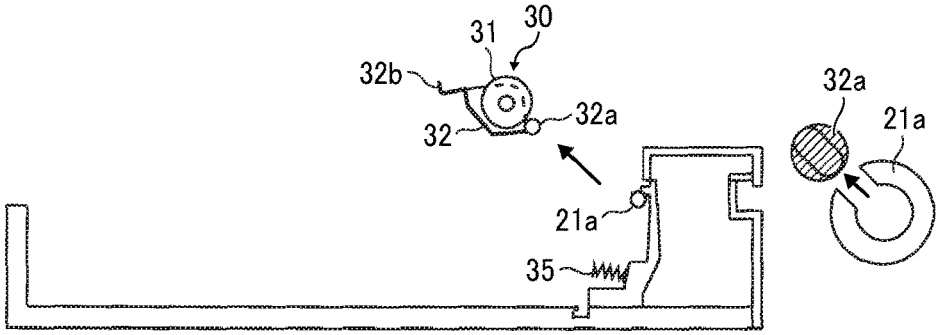
FIG. 8D is a diagram illustrating yet another process of removal of a sheet separation roller from the sheet feed tray.

To be more specific, as illustrated on the right side in FIGS. 8A, 8C and 8D, the end portion of the rotary shaft 32*a* of the holding member 32 has an oval shape. By contrast, the support shaft 21*a* has an opening or a hole into which the oval shaped end portion of the rotary shaft 32*a* of the holding member 32 is inserted. The opening of the support shaft 21*a* has a cut portion. Consequently, as illustrated on the right side in FIG. 8A, when the sheet separation roller unit 30 is attached to the sheet feed tray 21, a position of the oval shaped end portion of the rotary shaft 32*a* in the longitudinal direction does not match a position of the cut of the opening of the support shaft 21*a*. Accordingly, the rotary shaft 32*a* is inserted into the support shaft 21*a*. By contrast, illustrated on the right side in FIGS. 8C and 8D, when the sheet separation roller unit 30 is rotated to the predetermined position to be detached from the sheet feed tray 21, the position of the oval shaped end portion of the rotary shaft 32*a* in the longitudinal direction matches the position of the cut of the opening of the support shaft 21*a*. Accordingly, the rotary shaft 32*a* can be separated from the support shaft 21*a*.

As illustrated in FIGS. 8B and 9A, in the present embodiment, the holding member 32 includes a handle 32*b*. The handle 32*b* of the holding member 32 projects out at a position at which the handle 32*b* is exposed from the sheet feed tray 21 while the cover 33 is removed from the sheet feed tray 21.

In addition, in a state in which the cover 33 is detached from the sheet feed tray 21 and the sheet separation roller 31 is not in contact with the sheet feed roller 24, while the handle 32*b* is being held, the holding member 32 of the sheet separation roller unit 30 is rotatable to the predetermined position illustrated in FIG. 8D.

By providing the handle 32*b*, the sheet separation roller unit 30 is rotated to the predetermined position easily, and therefore the operability in replacement of the sheet separation roller unit 30 is enhanced.

Next, a description is given of a series of processes for replacement of the sheet separation roller 31 of the sheet separation roller unit 30, with reference to FIGS. 8A, 8B, 8C and 8D.

First, as illustrated in FIG. 8A, the sheet feed tray 21 is detached from the apparatus body 110 of the image forming apparatus 100. That is, the sheet feed tray 21 is removed from the apparatus body 110 of the image forming apparatus 100, as illustrated in FIG. 2B. Then, as illustrated in FIG. 8B, the cover 33 is detached from the sheet feed tray 21. At this time, as previously described, the cover 33 is detached without using any tool but by disconnecting the snap fit connection.

Thereafter, as illustrated in FIG. 8C, while the handle 32*b* is being held, the sheet separation roller unit 30 is rotated about the support shaft 21*a* in the clockwise direction. Then, after having been rotated and held at a predetermined position illustrated in FIG. 8C, the sheet separation roller unit 30 is moved in an upper left direction as illustrated in FIG. 8D. With this action, detachment of the sheet separation roller unit 30 from the sheet feed tray 21 is completed.

It is to be noted that a stopper mechanism is preferably provided to restrain further rotation of the sheet separation roller unit 30 beyond the predetermined position when the sheet separation roller unit 30 is rotated to and held at the predetermined position illustrated in FIG. 8C. According to this configuration, the operability is further enhanced in detachment of the sheet separation roller unit 30.

After the old sheet separation roller unit 30 has been removed from the sheet feed tray 21, a new sheet separation roller unit 30 or a post-maintenance sheet separation roller unit 30 is attached to unit to the sheet feed tray 21. This attaching process of the sheet separation roller unit 30 is performed in the reverse order of the above-described detaching process of the sheet separation roller unit 30. At this time, the cover 33 is detached by disconnecting the snap fit connection without using any tool.

As described above, in the present embodiment, the sheet separation roller 31 of the sheet separation roller unit 30 is replaced easily, without tightening or loosening screws using a tool.

Figure 9B:
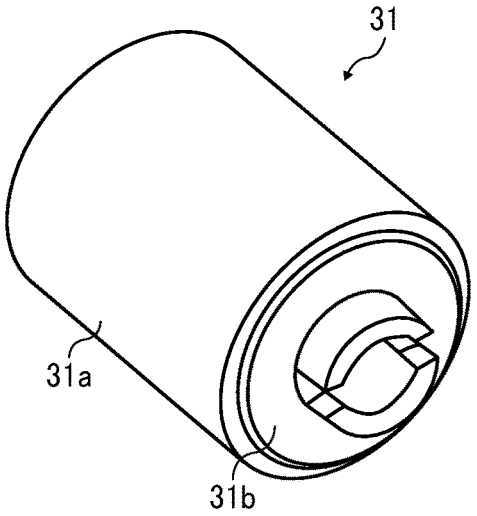
FIG. 9B is a perspective view illustrating the sheet separation roller.

As illustrated in FIG. 9B, the sheet separation roller 31 according to the present embodiment includes a torque limiter 31*b* to apply a load to rotation of the sheet separation roller 31. The torque limiter 31*b* applies conveyance resistance to a lowermost sheet P of multiple sheets P that are possibly multifed, so as to separate the lowermost sheet P form the other sheets P.

To be more specific, a driving force applied by the drive motor 40 is transmitted to the sheet separation roller 31 via a gear train and the torque limiter 31*b*. The torque limiter 31*b* has a predetermined drag torque value. When two or more sheets P enter the sheet feeding nip region between the sheet feed roller 24 and the sheet separation roller 31, the torque limiter 31*b* transmits a driving force to the sheet separation roller 31 to rotate the sheet separation roller 31 in the counterclockwise direction in FIG. 3, which is a direction opposite the sheet conveying direction. As the sheet separation roller 31 rotates in the counterclockwise direction, the lowermost sheet P is separated from the other sheets of the multiple sheets P that are possibly multifed. When no or one sheet P enters the sheet feeding nip region between the sheet feed roller 24 and the sheet separation roller 31, the torque limiter 31*b* applies a torque exceeding the predetermined drag torque value to cause the sheet separation roller 31 to be rotated with rotation of the sheet feed roller 24 in the clockwise direction in FIG. 3.

By providing the torque limiter 31*b* to the sheet separation roller 31, the performance of separation of the sheet separation roller 31 is enhanced.

Variation.

Figure 10A:
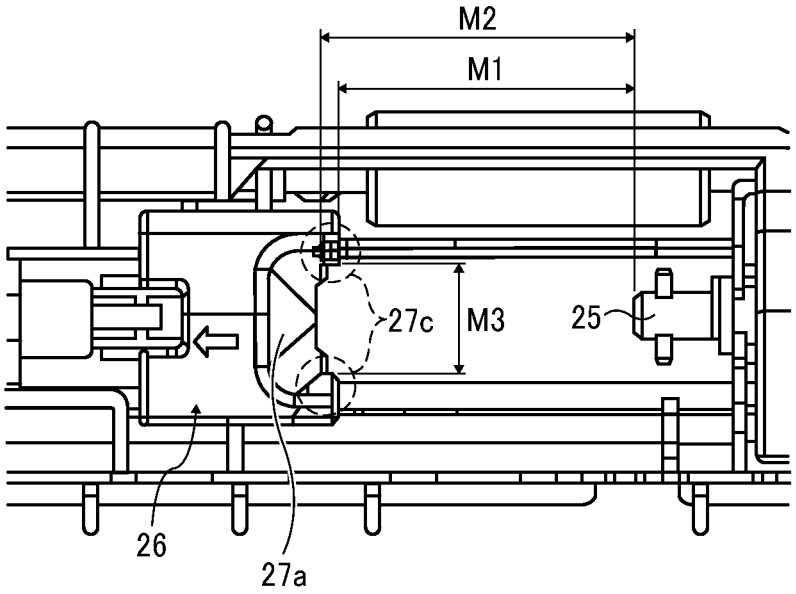
FIG. 10A is a diagram illustrating a state in which the sheet feed roller is removed from the sheet feeding device according to Variation of this disclosure.
Figure 10B:
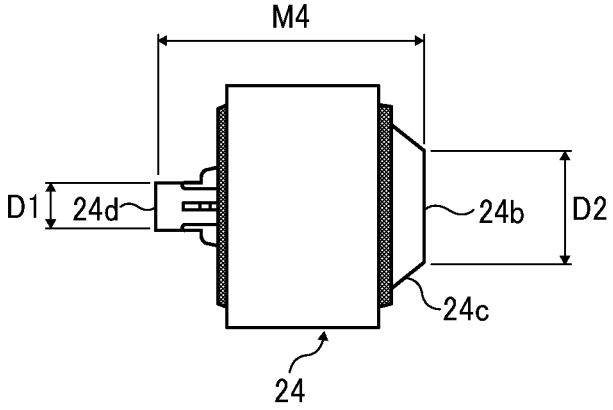
FIG. 10B is a diagram illustrating the sheet feed roller.
Figure 11A:
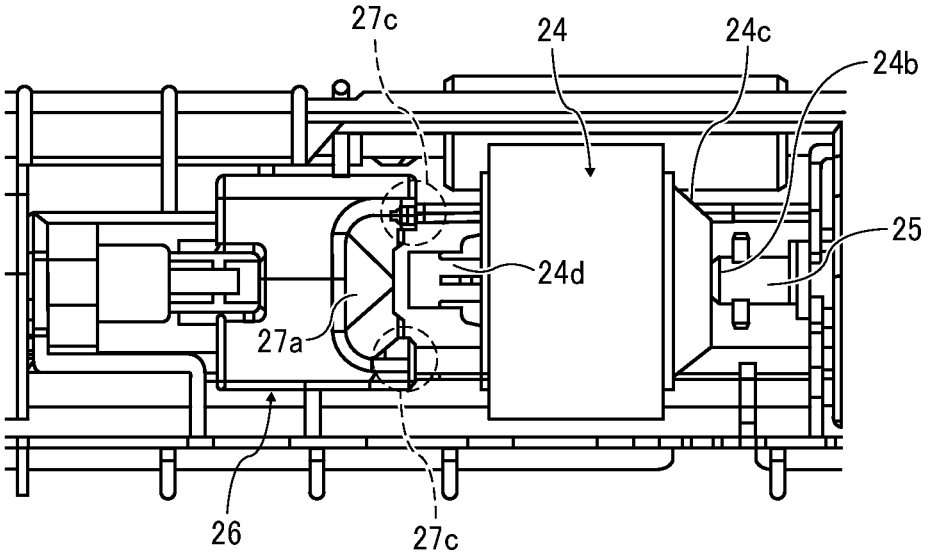
FIG. 11A is a diagram illustrating a state in which the sheet feed roller is attached normally in the sheet feeding device according to Variation of this disclosure.
Figure 11B:
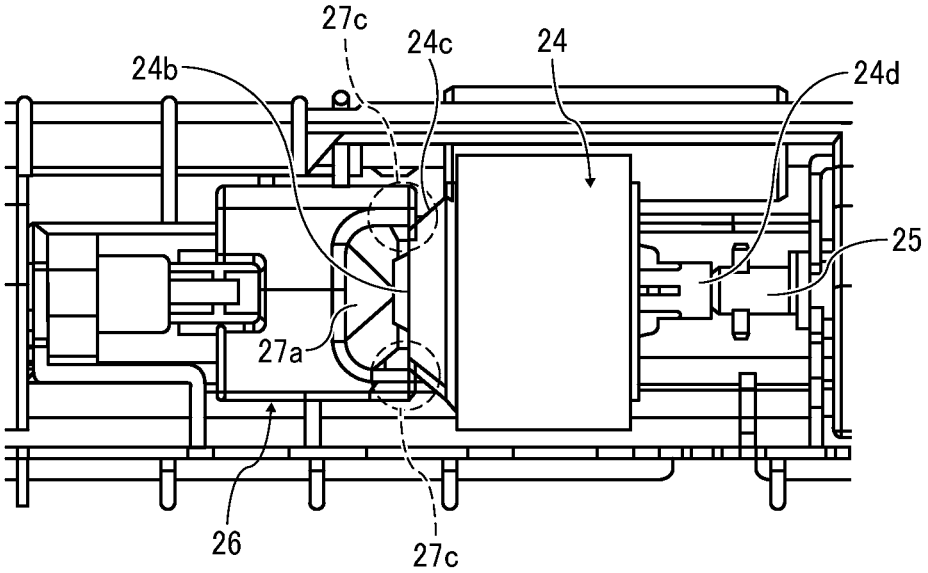
FIG. 11B is a diagram illustrating a state in which the sheet feed roller is not attached normally in the sheet feeding device.

FIG. 10A is a diagram illustrating a state in which the sheet feed roller 24 is removed from the sheet feeding device 20 according to Variation of this disclosure. FIG. 10B is a diagram illustrating the sheet feed roller 24. FIG. 11A is a diagram illustrating a state in which the sheet feed roller 24 is attached normally in the sheet feeding device 20 according to Variation of this disclosure. FIG. 11B is a diagram illustrating a state in which the sheet feed roller 24 is not attached normally in the sheet feeding device 20. FIGS. 10A, 11A and 11B are diagrams of the sheet feeding device 20, viewed from a direction in which the sheet feed roller 24 is attached or detached.

As illustrated in FIGS. 10A through 11B, the configuration and functions of the sheet feeding device 20 of Variation is basically identical to the configuration and functions of the sheet feeding device 20 illustrated in FIGS. 1 through 9B, except that the sheet feeding device 20 of Variation includes projections 27*c* formed on the movable member 26. Each of the projections 27*c* functions as a regulator.

As illustrated in FIG. 10B, similar to the sheet feed roller 24 of the embodiment of this disclosure, the sheet feed roller 24 of Variation includes the driven side engaging portion 24*d* having an outer diameter D1 is smaller than an outer diameter D2 of the leading end of the tapered portion 24*c* having a substantially conical frustum on the drive side, which is on the side of the drive side engaging portion 24*b* (D1<D2).

Further, similar to the movable member 26 of the embodiment of this disclosure, the movable member 26 of Variation is a member in which the shaft 28 is pressed and inserted into the movable main portion 27. The movable member 26 includes the holding portion 28*a*, the guide 27*a*, and the handle 27*b* and is movable in the direction of the rotational axis (i.e., the left and right directions in FIGS. 10A through 11B).

Further, similar to the configuration of the embodiment of this disclosure, the driven side engaging portion 24*d* of the sheet feed roller 24 is guided by the guide 27*a* of the movable member 26, and therefore the sheet feed roller 24 is attached to the sheet feeding device 20, as illustrated in FIG. 11A. That is, the driven side engaging portion 24*d* of the sheet feed roller 24 is inserted into the holding portion 28*a* of the movable member 26.

The movable member 26 of Variation includes the projections 27*c*, each of which functions as a regulator. The movable member 26 moves to a possible range in the direction of the rotational axis as indicted by white arrow illustrated in FIG. 10A, against the biasing force applied by the compression spring 29 that functions as a biasing member. In this state, there is a case that the sheet feed roller 24 is about to be attached to the sheet feeding device 20, with the axial orientation being reversed or in an incorrect orientation, as illustrated in FIG. 11B. In this case, the projections 27*c* contact the tapered portion 24*c* to avoid the attachment of the sheet feed roller 24.

To be more specific, as illustrated in FIG. 10A, the projections 27*c* function as a leading end of the movable main portion 27 of the movable member 26 on the drive side. The projections 27*c* are disposed at both ends of the sheet feed roller 24, across the center of rotation axis, and are projected by a predetermined amount (M2−M1) on the drive side (i.e., the right side of FIG. 10A).

With reference to FIGS. 10A and 10B, the following relations are established:

$$M1<M4<M2, \text{ and}$$

$$D1<M3<D2,$$

where a distance between the two projections 27*c* is represented as "M3", a distance in the direction of rotational axis between the leading end of each of the projections 27*c* and the leading end of the drive shaft 25 is represented as "M1", a distance in the direction of rotational axis between the root of each of the projections 27*c* and the leading end of the drive shaft 25 is represented as "M2", and a distance in the direction of rotational axis from the leading end of the tapered portion 24*c* of the sheet feed roller 24 to the leading end of the driven side engaging portion 24*d* (having the small diameter) is represented as "M4".

According to this configuration, as illustrated in FIG. 11B, even when a user attempts to attach the sheet feed roller 24 in reverse in the direction of rotational axis by mistake, the tapered portion 24*c* of the sheet feed roller 24 interferes with the projections 27*c* (the regulators) of the movable member 26, and therefore the sheet feed roller 24 cannot be set to the sheet feeding device 20. That is, this configuration can prevent the setting error of the sheet feed roller 24.

As described above, the sheet feeding device 20 according to the present embodiment is provided to enhance the operability in replacement of the sheet feed roller 24 and the sheet separation roller 31. Therefore, the operability in maintenance of the sheet feeding device 20 is also enhanced.

It is to be noted that the image forming apparatus 100 according to an embodiment of this disclosure employs a monochrome image forming apparatus but the configuration of the image forming apparatus 100 is not limited thereto. For example, a color image forming apparatus is also applicable to achieve the effect of this disclosure.

Further, it is to be noted that the image forming apparatus 100 that employs electrophotography is applied in the present embodiment of this disclosure. However, the configuration of the image forming apparatus 100 is not limited thereto but can be applied to any image forming apparatus having different methods. For example, this disclosure is also applicable to an image forming apparatus that employs an inkjet method or to an offset printing machine.

Further, even if any of these image forming apparatuses is applied, the same effect as the image forming apparatus 100 according to the present embodiment of this disclosure can be provided.

It is to be noted that, as described above, a "sheet" in this specification is not limited to indicate a paper but also includes any other sheet-like recording medium such as a coated paper sheet, a label paper, an OHP film sheet, and a film.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet feeding device comprising:

a sheet loader on which a sheet is loaded;

a roller detachably attached to an apparatus body of an image forming apparatus and having a first engaging portion and a second engaging portion opposite to the first engaging portion, the roller configured to feed the sheet loaded on the sheet loader in a sheet conveying direction;

a drive device configured to rotate the roller;

a shaft rotated by the drive device, the shaft configured to engage with the first engaging portion of the roller and transmit a driving force to the roller;

a movable body configured to move in a direction parallel to a rotational axis of the shaft, the movable body including:

a holding portion configured to engage with the second engaging portion of the roller and rotatably hold the roller, a guide configured to guide attachment of the second engaging portion of the roller to the holding portion; and a biasing body configured to apply a biasing force and bias the movable body from a drive receiving side to a drive transmitting side, wherein the roller includes a tapered portion having a conical frustum shape on the drive transmitting side, and the movable body includes a regulator configured to contact the tapered portion of the roller and avoid attachment of the roller when the roller is being attached in an incorrect orientation while the movable body is moved in the direction parallel to the rotational axis of the shaft against the biasing force applied by the biasing body.

2. The sheet feeding device according to claim 1, wherein the roller has the conical frustum shape in which a distance between a roller body and the first engaging portion becomes narrower toward the drive transmitting side.

3. The sheet feeding device according to claim 2, wherein the roller includes the tapered portion having the conical frustum shape on the drive transmitting side, and an outer diameter of the second engaging portion of the roller is smaller than an outer diameter of a leading end of the tapered portion.

4. The sheet feeding device according to claim 1, wherein the movable body includes a handle projected at a position where the handle is exposed outside, and the movable body is moved in the direction of the rotational axis against the biasing force of the biasing body while the handle is being held.

5. The sheet feeding device according to claim 1, wherein the guide has a sloped face tilted toward the holding portion from the drive receiving side to the drive transmitting side, viewed from a proximal side of a direction of attachment of the roller.

6. The sheet feeding device according to claim 5, further comprising:

a cover detachably attached to the sheet feeding device;

an opposing roller covered by the cover and configured to contact the roller and form a nip region with the roller;

a second biasing body; and a pre-separation body rotatably supported by the cover and biased by the second biasing body, the pre-separation body configured to rotate operable to contact the roller upstream, in the sheet conveying direction, from a position at which the opposing roller contacts the roller.

7. The sheet feeding device according to claim 5, further comprising:

a cover detachably attached to the sheet feeding device;

an opposing roller covered by the cover and configured to contact the roller and form a nip region with the roller; and a holding body rotatably supported by a sheet feed tray, the holding body configured to rotatably support the opposing roller such that, in a state in which the cover is removed and the opposing roller is not in contact with the roller, the holding body is removable while supporting the opposing roller after being rotated to a position beyond a contact position at which the opposing roller and the roller contact with each other.

8. The sheet feeding device according to claim 7, wherein the holding body includes a handle projecting out at a position at which the handle is exposed while the cover is removed, and wherein, in a state in which the cover is removed and the opposing roller is not in contact with the roller, the holding body is rotated to the position beyond the contact position while the handle is being held.

9. The sheet feeding device according to claim 5, further comprising:

an opposing roller configured to contact the roller and form a nip region with the roller the opposing roller including a torque limiter configured to apply a load to rotation of the opposing roller.

10. The sheet feeding device according to claim 1, further comprising:

an opposing roller configured to contact the roller and form a nip region with the roller;

a cover detachably attached to the sheet feeding device, the cover configured to cover the opposing roller, the cover being detached from the sheet feeding device due to deformation by application of manual pressure;

a holding body rotatably supported by a sheet feed tray, the holding body configured to rotatably support the opposing roller and the holding body operable to expose part of an outer circumferential surface of a roller body of the opposing roller; and a second biasing body configured to apply a second biasing force and bias and rotate the holding body operable to cause the opposing roller to contact the roller.

11. The sheet feeding device according to claim 10, wherein the cover is configured to serve as at least a part of an inner wall disposed at a downstream side of the sheet conveying direction, in a space where the sheet is loaded and contained.

12. The sheet feeding device according to claim 10, wherein an engaging portion of the cover includes a snap-fit structure, and a portion where the cover is pressed manually includes a rib-like projection.

13. The sheet feeding device according to claim 10, further comprising:

a pre-separation body rotatably supported by the cover and biased by the second biasing body, the pre-separation body configured to rotate operable to contact the roller upstream, in the sheet conveying direction, from a position at which the opposing roller contacts the roller.

14. The sheet feeding device according to claim 10, wherein, in a state in which the cover is removed and the opposing roller is not in contact with the roller, the holding body is removable while supporting the opposing roller after being rotated to a position beyond a contact position at which the roller and the opposing roller contact with each other.

15. The sheet feeding device according to claim 14, wherein the holding body includes a handle projecting out at a position at which the handle is exposed while the cover is removed, and wherein, in a state in which the cover is removed and the opposing roller is not in contact with the roller, the holding body is rotated to the position beyond the contact position while the handle is being held.

16. The sheet feeding device according to claim 10, further comprising:

the sheet feed tray detachably attached to the apparatus body of the image forming apparatus.

17. An image forming apparatus comprising:

the sheet feeding device according to claim 1.

* * * * *